US006692342B2

(12) United States Patent
Nakamura et al.

(10) Patent No.: US 6,692,342 B2
(45) Date of Patent: Feb. 17, 2004

(54) WAFER ABRASIVE MACHINE

(75) Inventors: Yoshio Nakamura, Nagano (JP); Tsuyoshi Hasegawa, Nagano (JP); Susumu Onishi, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 22 days.

(21) Appl. No.: 10/081,493

(22) Filed: Feb. 22, 2002

(65) Prior Publication Data

US 2002/0119735 A1 Aug. 29, 2002

(30) Foreign Application Priority Data

Feb. 28, 2001 (JP) ..... 2001-055177

(51) Int. Cl.[7] ..... B24B 25/00
(52) U.S. Cl. ..... 451/287; 451/289; 451/388
(58) Field of Search ..... 451/285, 286, 451/287, 288, 388, 398

(56) References Cited

U.S. PATENT DOCUMENTS 5,441,444 A * 8/1995 Nakajima ..... 451/289
6,422,928 B1 * 7/2002 Nakamura et al. ..... 451/288

FOREIGN PATENT DOCUMENTS

| | | |
|---|---|---|
| JP | 06126615 | 5/1994 |
| JP | 08229808 | 9/1996 |
| JP | 00127024 | 5/2000 |
| JP | 00299301 | 10/2000 |
| JP | 00343410 | 12/2000 |

* cited by examiner

*Primary Examiner*—Dung Van Nguyen
(74) *Attorney, Agent, or Firm*—Jordan & Hamburg LLP

(57) ABSTRACT

In the wafer abrasive machine of the present invention, a gravity center and a rotational axis of a wafer can be corresponded while abrading the wafer and a holding plate can be smoothly moved in a head member. The abrasive machine comprises: the head member including a concave section, in which the holding plate is accommodated; an elastic sheet member suspending the holding plate and being reinforced by a cloth-formed reinforcing member; a space for storing pressure fluid which pushes the holding plate toward the abrasive plate, the space being formed between the elastic sheet member and the concave section; and a plurality of spherical bodies being provided between an outer circumferential face of the holding plate and an inner circumferential face of the concave section, the spherical bodies simultaneously point-contact the both circumferential faces.

26 Claims, 9 Drawing Sheets

WAFER ABRASIVE MACHINE

BACKGROUND OF THE INVENTION

The present invention relates to a wafer abrasive machine, more precisely relates to a wafer abrasive machine, in which a surface of a wafer held by a holding plate is pressed onto an abrasive face of an abrasive plate and relatively moved with respect thereto so as to abrade the surface of the wafer.

An example of a conventional abrasive machine for abrading silicon wafers for semiconductor devices is shown in FIGS. 9 and 10. FIG. 9 is a partial sectional view of the conventional machine; FIG. 10 is a partial enlarged view of the machine shown in FIG. 9.

In the abrasive machine shown in FIGS. 9 and 10, an abrasive face 22 is constituted by an abrasive cloth 21 adhered on an upper face of an abrasive plate 20.

A top ring "T" is headed toward the abrasive face 22 and provided to a lower end of a rotary shaft 28, which is rotated by a motor 64 with gears 66 and 68. The top ring "T" and the rotary shaft 28 are vertically moved by a cylinder unit 56.

A through-hole 30 is formed in the rotary shaft 28, and a suction pipe 18, which is connected to a connecting port 74 communicated with a vacuum generator, runs through the through-hole 30. A space between the suction pipe 18 and an inner face of the through-hole 30 is an air path 32, which is connected to a connecting port 76 communicated with an air compressor. Therefore, compressed air, which is a pressure fluid, runs through the air path 32.

The top ring "T" provided to the lower end of the rotary shaft 28 includes a head member 24, which is fixed to the rotary shaft 28, and a holding plate 10, which is held and accommodated in a concave section 26 of the head member 24 and whose lower face 11 faces the abrasive face 22 of the abrasive plate 20. The lower face 11 of the holding plate 10 acts as a holding face capable of sucking and holding a silicon wafer "W". A plurality of holes 12 are opened in the holding face 11 of the holding plate 10. As shown in FIG. 10, the holes 12 are mutually communicated by a horizontal connecting path 14 formed in the holding plate 10. The connecting path 14 is communicated to the suction pipe 18 via a connector 16. With this structure, the wafer "W" can be sucked and held on the holding face 11 of the holding plate 10 by driving the vacuum generator.

The holding plate 10, whose holding face 11 faces the abrasive face 22 of the abrasive plate 20, is suspended and accommodated in the concave section 26 of the head member 24 by a elastic sheet member 38, which is formed into a donut-shape and made of rigid rubber. A symbol "h" stands for a length of projecting the holding plate 10 from the concave section 26.

An elastic O-ring 34, which is made of rubber or the like, is provided between an outer circumferential face 10*a* of the holding plate 10 accommodated in the concave section 26 and an inner circumferential face 24*a* of the concave section 26. The O-ring 34 contacts the both faces 10*a* and 24*a*. With this structure, the holding plate 10 can be slightly moved in the horizontal direction and capable of absorbing a horizontal functional force which is generated while the wafer "W" is abraded.

A ring-shaped restraint member 36, which is made of resin, e.g., acetyl resin, is fitted in the concave section 26 so as not to damage the holding plate 10. The restraint member 36 restrains the horizontal movement of the holding plate 10, which is accommodated in the concave section 26, within a prescribed range.

By the O-ring 34 and the restraint member 36, the horizontal movement of the holding plate 10 is limited, the vertical movement thereof is allowed.

An outer edge of the elastic sheet member 38, which suspends the holding plate 10 in the concave section 26, contacts an upper face of a step section 24*b*, which is formed along an outer edge of an inner upper face of the concave section 26, and is air-tightly fixed thereto by a fixing plate 40 and screws 42. An inner edge of the elastic sheet member 38 is air-tightly fixed to an upper face of the holding plate 10 as well. With this structure, a space 50 is formed between the elastic sheet member 38 and the inner upper face of the concave section 26. The air path 32 for introducing the compressed air is communicated to the space 50.

When the air compressor is driven and the compressed air is introduced into the space 50 via the air path 32, inner pressure of the space 50 rises. If the inner pressure is greater than elastic force of the elastic sheet member 38 which biases the holding plate 10 toward the inner upper face of the concave section 26, the lower end part of the holding plate is further projected from the concave section 26 as shown in FIG. 11. A symbol "h" shown in FIG. 11 stands for the length of projecting the holding plate 10, which has been further projected by the compressed air. Of course, the length "h" is longer than the length "h" (see FIG. 10).

In the case of abrading the wafer "W" by the abrasive machine shown in FIGS. 9 and 10, the wafer "W" is sucked and held on the holding face 11 of the holding plate 10, and a bottom surface of the wafer "W" is headed toward the abrasive face 22 of the abrasive plate 20. Then the wafer "W" and the abrasive plate 20 are relatively moved so as to abrade the bottom surface of the wafer "W". While the abrasion, a pressing force of the cylinder unit 56 and the inner pressure of the space 50 are adjusted so as to press the bottom surface of the wafer "W" onto the abrasive face 22 of the abrasive plate 20 with proper force.

To easily control the length of projecting the holding plate 10 from the concave section 26 of the head member 24, the elastic sheet member 38 made of soft rubber was used instead of that made of the rigid rubber. In this case, the elastic sheet member 38 was excessively extended despite the inner pressure of the space 50 was slightly risen. To properly extend the elastic sheet member 38 when an external force is applied, the elastic sheet member 38 is reinforced by a cloth-formed reinforcing member 41 as shown in FIG. 12A.

The cloth-formed reinforcing member 41 is shown in FIG. 12B. When external forces F1 are applied to warps 41*a* and woofs 41*b* in parallel, the reinforcing member 41 is less deformed. On the other hand, when external forces F2 are diagonally applied to the warps 41*a* and woofs 41*b*, the reinforcing member 41 is fairly deformed. Degree of extension of the cloth-formed reinforcing member 41 is varied by the direction of the external force.

Since the holding plate 10 is suspended by the elastic sheet member 38 whose degree of extension is varied by the direction of the external force, the movement of the holding plate 10 is varied by the direction of the external force applied while the holding plate 10 is rotated. By the variation of the movement of the holding plate 10, a gravity center of the wafer "W", which is held and pressed by the holding plate 10, is shifted from a rotational axis thereof, so that an edge of the wafer "W" is apt to be abraded diagonally.

If density of fibers, i.e., warps and woofs, of the reinforcing member 41 is made higher, the variation of the deformation of the elastic sheet member 38, which depends on the direction of the external force, can be made small, but the problem caused by the variation still exists. Further, the reinforcing member 41 whose density of fibers is high is apt to peel from the rubber constituting the elastic sheet member 38.

In the top ring "T" shown in FIGS. 9 and 10, the O-ring 34 made of rubber and the restraint member 36 made of acetyl resin are provided between the outer circumferential face 10*a* of the holding plate 10 and the inner circumferential face 24*a* of the concave section 26 so as to limit the horizontal movement of the holding plate 10.

However, the O-ring 34 and the restraint member 36 allow the holding plate 10 in the concave section 26 to move in the radial directions. Therefore, in the abrasive machine shown in FIGS. 9 and 10, the gravity center of the wafer "W" is apt to shift from the rotational axis thereof while abrading the wafer "W". If the gravity center of the wafer "W" is shifted from the rotational axis, the edge of the wafer "W" is diagonally abraded.

Further, the O-ring 34 and the restraint member 36 line- or plane-contact the outer circumferential face 10*a* of the holding plate 10 and the inner circumferential face 24*a* of the concave section 26 throughout the faces 10*a* and 24*a*, so the holding plate 10 cannot be smoothly projected from and retracted into the concave section 26 by friction there between.

SUMMARY OF THE INVENTION

A first object of the present invention is to provide a wafer abrasive machine, in which an elastic sheet member for suspending and biasing a holding plate toward an inner part of a concave section of a head member is reinforced by a cloth-formed reinforcing member capable of easily extending and in which a gravity center and a rotational axis of a wafer can be corresponded while abrading the wafer so as to smoothly move the holding plate, etc. in the concave section.

A second object of the present invention is to provide a wafer abrasive machine, which makes an abrasion cloth of an abrasive plate flat so as not to diagonally abrade an edge of the wafer.

To achieve the objects, the inventors of the present invention have studied and found that the gravity center and the rotational axis of the wafer, which is held by the holding plate and pressed onto an abrasive face of an abrasive plate, can be corresponded by providing spherical bodies between an outer circumferential face of the holding plate, which is suspended and biased upward by the elastic sheet member, and an inner circumferential face of the concave section of the head member. By corresponding the gravity center of the wafer to the rotational axis thereof, the holding plate can be smoothly projected from and retracted into the concave section of the head member.

Namely, a first structure of the present invention is the abrasive machine, in which a surface of a wafer held by a holding plate is pressed onto an abrasive face of an abrasive plate and relatively moved with respect thereto so as to abrade the surface of the wafer, comprises:

- a head member including a concave section, in which the holding plate, whose wafer holding face is headed toward the abrasive face of the abrasive plate, is accommodated;
- an elastic sheet member suspending the holding plate and biasing the holding plate toward an inner part of the concave section of the head member, the elastic sheet member being reinforced by a cloth-formed reinforcing member;
- a space for storing pressure fluid which pushes the holding plate toward the abrasive plate against elasticity of the elastic sheet member, the space being formed between the elastic sheet member and an inner upper face of the concave section of the head member; and
- a plurality of spherical bodies being provided between an outer circumferential face of the holding plate and an inner circumferential face of the concave section of the head member, the spherical bodies simultaneously point-contact the both circumferential faces.

And, the inventors also found that the second object can be achieved by biasing a dress ring, which encloses the holding plate and presses the abrasive face of the abrasive plate, by the elastic sheet member.

Namely, a second structure of the present invention is the abrasive machine, in which a surface of a wafer held by a holding plate is pressed onto an abrasive face of an abrasive plate and relatively moved with respect thereto so as to abrade the surface of the wafer, comprises:

- a head member including a concave section, in which the holding plate, whose wafer holding face is headed toward the abrasive face of the abrasive plate, and a dress ring, which encloses the holding plate and presses the abrasive face of the abrasive plate so as to make it flat, are accommodated;
- an elastic sheet member suspending the holding plate and the dress ring and biasing the both toward an inner part of the concave section of the head member, the elastic sheet member being reinforced by a cloth-formed reinforcing member;
- a space for storing pressure fluid which pushes the holding plate toward the abrasive plate against elasticity of the elastic sheet member, the space being formed between the elastic sheet member and an inner upper face of the concave section of the head member; and
- a plurality of spherical bodies being provided between an outer circumferential face of the holding plate and an inner circumferential face of the dress ring and between an outer circumferential face of the dress ring and an inner circumferential face of the concave section of the head member, the spherical bodies simultaneously point-contact the circumferential faces.

In the abrasive machine having the first structure, the elastic sheet member is reinforced by the cloth-formed reinforcing member, degree of extension of the elastic sheet can be in a proper range.

Since the spherical bodies simultaneously point-contact the outer circumferential face of the holding plate, which is suspended and biased by the elastic sheet member, and the inner circumferential face of the concave section of the head member, the spherical bodies can prohibit the movement of the holding plate, for example, a movement in the radial direction of the concave section, which is caused by the directional property of the extension of the elastic sheet member. Therefore, the gravity center and the rotational axis of the wafer can be corresponded during the abrasion, so that the wafer can be uniformly abraded and the diagonal abrasion of the edge of the wafer can be prevented.

Further, the spherical bodies, which simultaneously point-contact the outer circumferential face of the holding plate and the inner circumferential face of the concave section of the head member, make the holding plate smoothly project from and retract into the concave section of the head member.

In the abrasive machine having the second structure, the dress ring enclosing the holding plate is accommodated in the concave section together with the holding plate.

The holding plate and the dress ring are suspended and inwardly biased by the elastic sheet member. The dress ring presses the abrasive face along the edge of the wafer, which is pressed depressed by the wafer, so as to make it flat. By making the abrasive face flat, the diagonal abrasion of the edge of the wafer can be prevented.

The elastic sheet member is reinforced by the cloth-formed reinforcing member, degree of extension of the elastic sheet can be in a proper range. Since the spherical bodies simultaneously point-contact the outer circumferential face of the holding plate, which is suspended and biased by the elastic sheet member, and the inner circumferential face of the dress ring and between the outer circumferential face of the dress ring and the inner circumferential face of the concave section of the head member, the spherical bodies can prohibit the movement of the holding plate, etc., which is caused by the directional property of the extension of the elastic sheet member. Therefore, the gravity center and the rotational axis of the wafer can be corresponded during the abrasion, and the dress ring can make the abrasion face of the abrasive plate, so that the wafer can be highly uniformly abraded.

Further, the spherical bodies, which simultaneously point-contact the circumferential faces, make the holding plate smoothly project from and retract into the concave section of the head member.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

The preferred embodiments of the present invention will now be described in detail with reference to the accompanying drawings.

Figure 1:
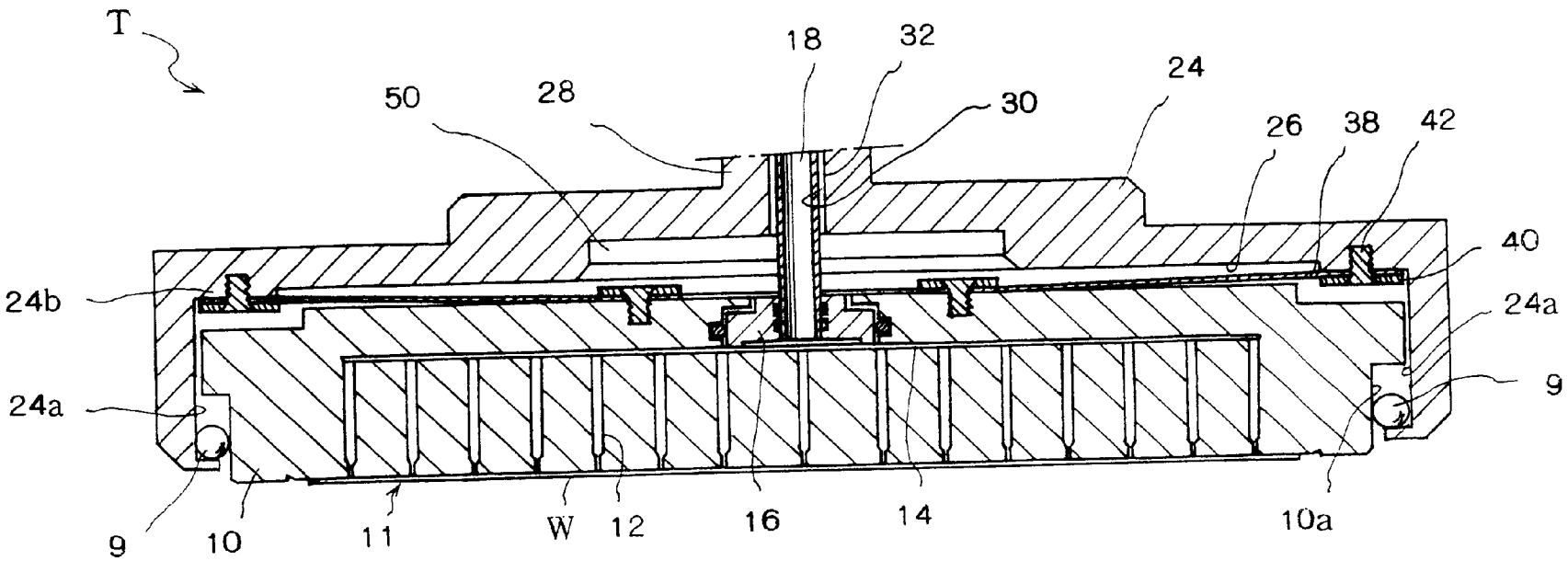
FIG. 1 is a sectional view of a top ring of the wafer abrasive machine of a first embodiment.

A top ring of the wafer abrasive machine of a first embodiment is shown in FIG. 1. The top ring "T" may be attached to the wafer abrasive machine shown in FIG. 9. The members used in the top ring shown in FIG. 10 are assigned the same symbols and explanation will be omitted.

Figure 12A:
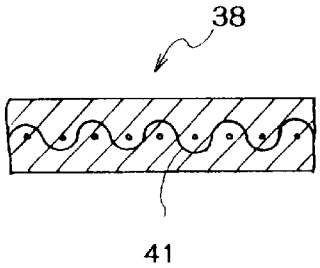
FIGS. 12A and 12B are explanation view of the cloth-formed reinforcing member.
Figure 12B:
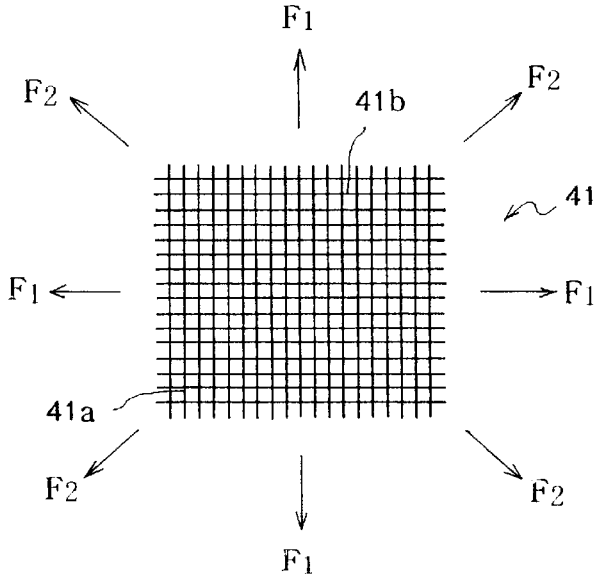

The top ring "T" shown in FIG. 1 includes the elastic sheet member 38, which biases the holding plate 10 upward, namely toward an inner upper face of the concave section 26 of the head member 24. The elastic sheet member 38 is reinforced by the cloth-formed reinforcing member 41 (see FIG. 12A). Degree of extension of the reinforcing member 41 is varied according to the direction of the external force (see FIG. 12B). The elastic sheet member 38 can be easily extend within a proper range by applying a proper external force, but the degree of the extension is varied by the directional property.

When the external force in the extendable direction, e.g., the radial direction of the concave section 26, is applied to the holding plate 10 suspended in the concave section 26 of the head member 24 by the elastic sheet member 38, the elastic sheet member 38 is extended in the radial direction, so that the holding plate 10 in the concave section 26 is biased in the same direction.

In the top ring "T" shown in FIG. 1, a plurality of spherical bodies 9 made of steel are provided between the outer circumferential face 10*a* of the holding plate 10 and the inner circumferential face 24*a* of the concave section 26 of the head member 24. And, the spherical bodies 9 simultaneously point-contact the both circumferential faces 10*a* and 24*a*. The spherical bodies 9 are arranged along the both circumferential faces 10*a* and 24*a* and point-contact each other.

A position of the holding plate 10 is fixed in the concave section 26 of the head member 24 by the spherical bodies 9 provided and fitted between the both circumferential faces 10*a* and 24*a*. With this structure, even if the external force in the radial direction of the concave section 26 is applied to the holding plate 10, movement of the holding plate 10 in the radial direction of the concave section 26 can be securely prevented by the spherical bodies 9.

On the other hand, the spherical bodies 9, which point-contact the outer circumferential face 10*a* of the holding plate 10, allow the holding plate 10 in the vertical direction, so that the holding plate 10 can be easily projected from and retracted into the concave section 26. Therefore, the projection length "h" of the holding plate 10 (see FIG. 10) can be easily adjusted by controlling the inner pressure of the space 50. And, the holding plate 10 is capable of easily following minute waving or rolling of the abrasive plate 10, which occurs during the abrasion of the wafer "W".

The spherical bodies 9 are provided on the holding face 11 side with respect to the elastic sheet member 38, so that the holding plate 10 can be smoothly moved in the concave section 26 in the vertical direction.

In the top ring "T" shown in FIG. 1, as described above, the spherical bodies 9 are provided on the holding face 11 side, so the there is possibility of damaging the spherical bodies 9 by slurry, which is supplied onto the abrasive face 22 of the abrasive plate 20. To prevent the damage of the spherical bodies 9, they may be made of a corrosion-resistible metal, e.g., stainless steel, titanium, or a hard corrosion-and chemical-resistible resin, e.g., acrylic.

Figure 2:
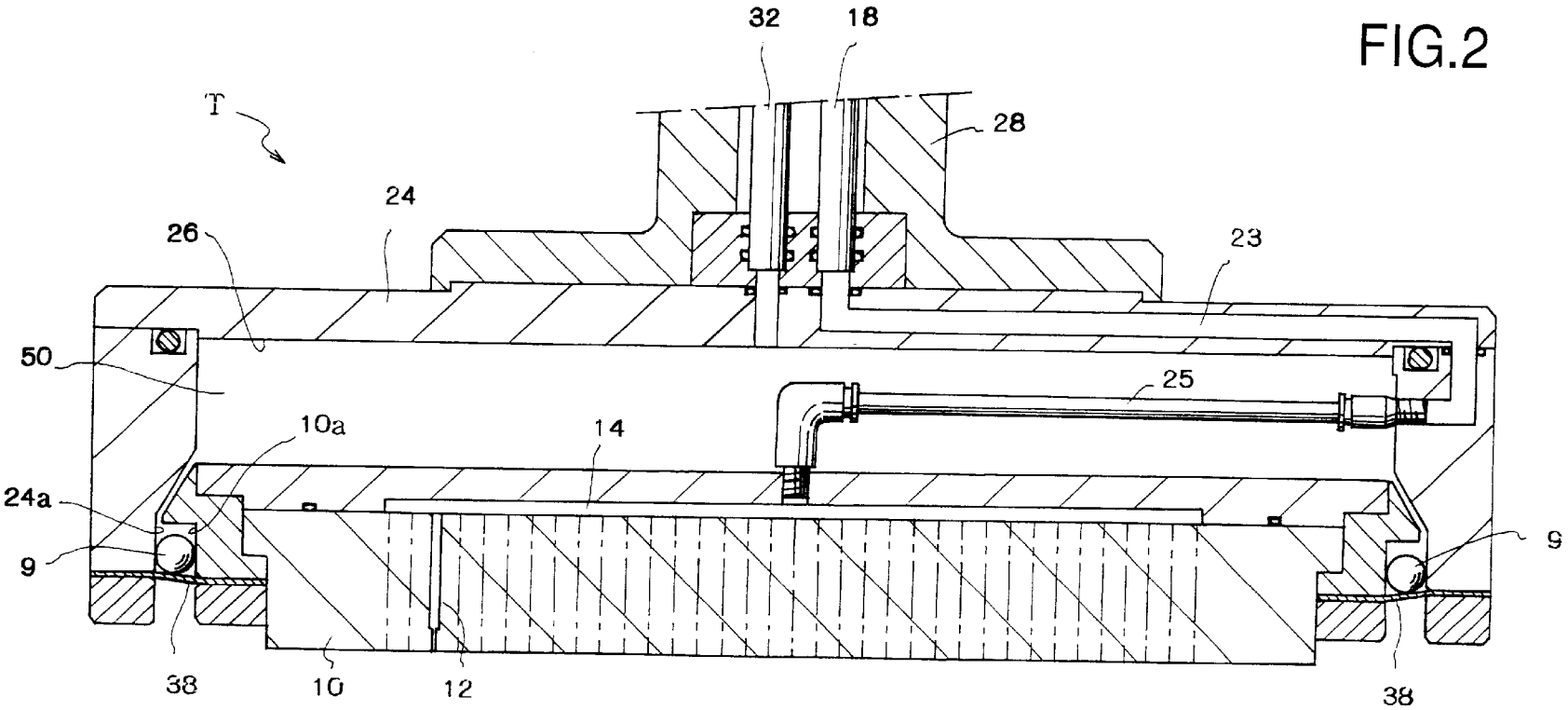
FIG. 2 is a sectional view of another top ring of the wafer abrasive machine of the first embodiment.

In FIG. 1, the spherical bodies 9 are provided on the holding face 11 side (the lower side) with respect to the elastic sheet member 38; as shown in FIG. 2, the spherical bodies 9 may be provided on the opposite side (the upper side) or the inner upper face side of the concave section 26 with respect to the elastic sheet member 38. In FIG. 2 too, the spherical bodies 9 are provided between the outer circumferential face 10*a* of the holding plate 10 and the inner circumferential face 24*a* of the concave section 26 of the head member 24. And, the spherical bodies 9 simultaneously point-contact the both circumferential faces 10*a* and 24*a*. The spherical bodies 9 are arranged along the both circumferential faces 10*a* and 24*a* and point-contact each other.

By providing the spherical bodies 9 on the upper side of the elastic sheet member 38, damaging the spherical bodies 9 by slurry applied to the abrasive face 22 of the abrasive plate 20 can be avoided. In this case, the elastic sheet member 36 is provided close to a lower opening end of the concave section 26 so as to smoothly move the holding plate 10.

Figure 9:
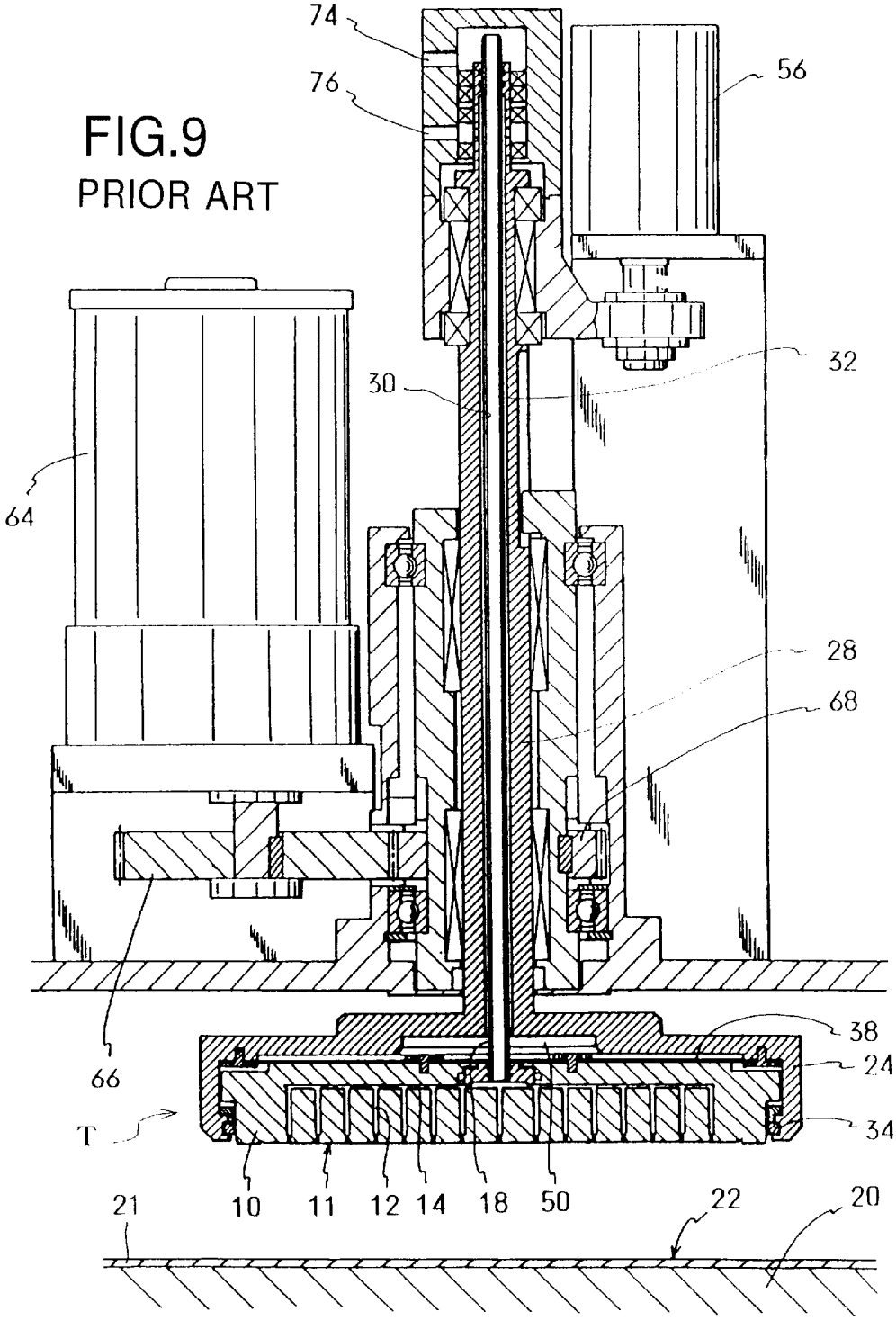
FIG.9 PRIOR ART
FIG. 9 is the partial sectional view of the conventional wafer abrasive machine.
Figure 10:
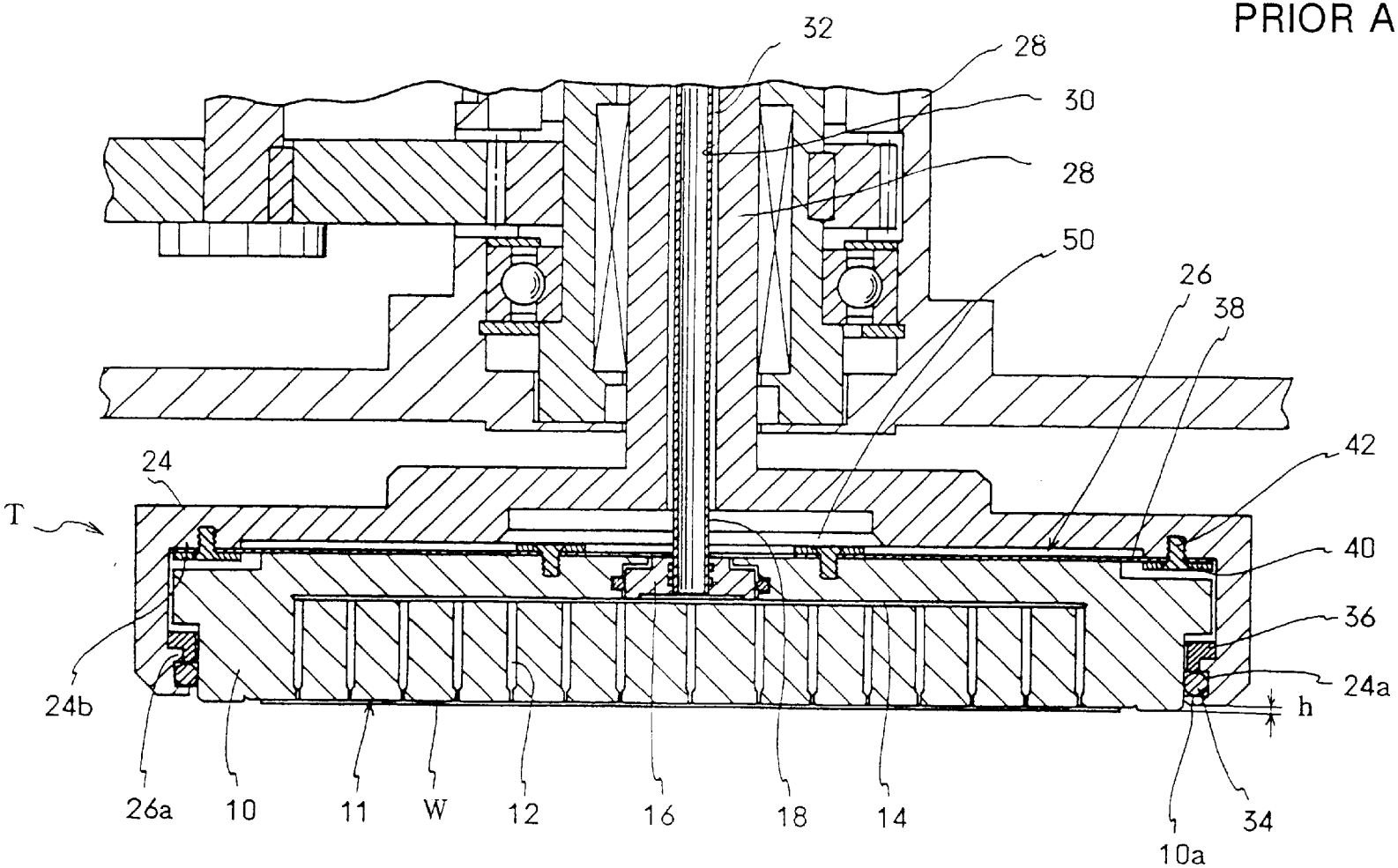
FIG.10 PRIOR ART
FIG. 10 is the partial enlarged view of the conventional machine shown in FIG. 9.
Figure 11:
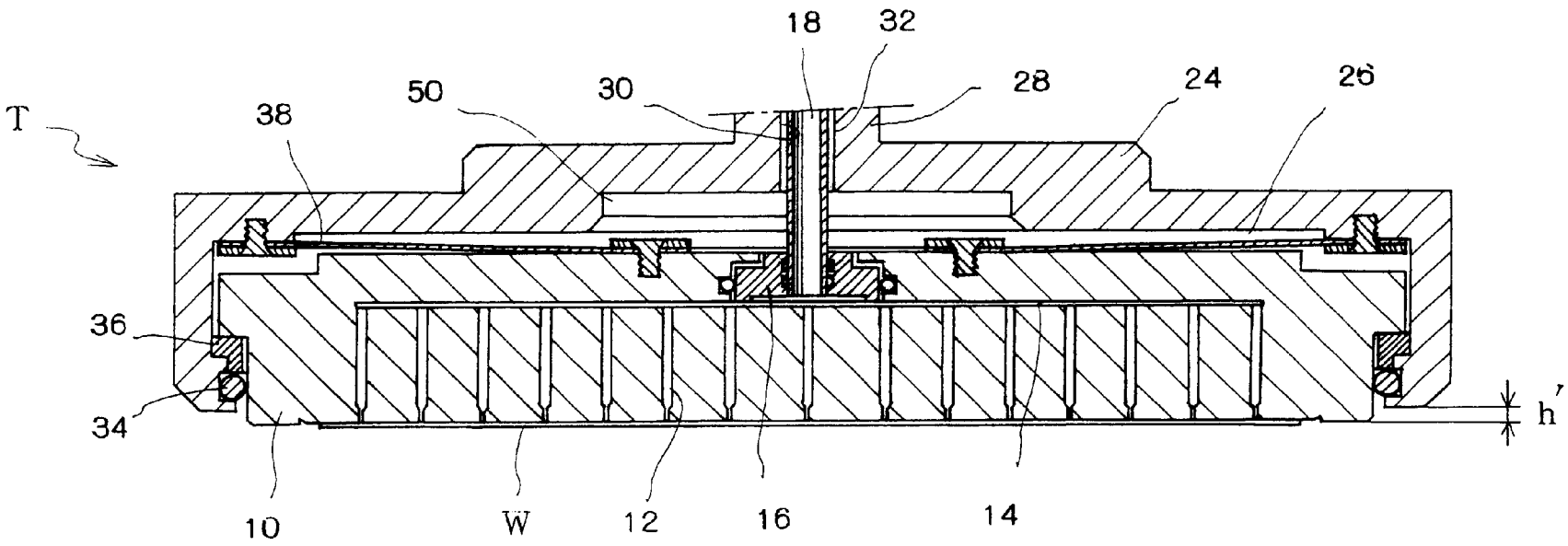
FIG.11 PRIOR ART
FIG. 11 is the sectional view of the top ring of the conventional machine shown in FIGS. 9 and 10, which shows function of the elastic sheet member.

In the top ring "T" shown in FIG. 2, the members used in the top ring shown in FIGS. 9 and 10 are assigned the same symbols and explanation will be omitted.

The suction pipe 18, which is connected to the connecting port 74 communicated to the vacuum generator, is connected to an air path 23 formed in the head member 24. The air path 23 is connected to the connecting path 14 formed in the holding plate 10 via a flexible pipe 25 provided in the space 50 which is formed between the holding plate 10 and the inner upper face of the concave section 26. With this structure, a vacuum suction mechanism for sucking and holding the wafer "W" on the holding face 11 of the holding plate 10 can be constituted.

The air path 32, which is connected to the connecting port 76 communicated to the air compressor, is separated from the suction pipe 18 and pierced through the rotary shaft 28. A lower end of the air path 32 is opened in the inner upper face of the concave section 26 so as to introduce the compressed air into the space 50. The air path 32 also discharges the air from the space 50. By controlling the inner pressure of the space 50, the holding plate 10 can be projected from and retracted into the concave section 26 of the head member 24.

In the top ring "T" shown in FIG. 2, the spherical bodies 9 are provided on the upper side of the elastic sheet member 38, so they maybe badly influenced by moisture in the compressed air introduced into the space 50. In this case, the spherical bodies 9 may be made of a corrosion-resistible metal, e.g., stainless steel, titanium, or a hard corrosion-and chemical-resistible resin, e.g., acrylic.

The top ring "T" shown in FIG. 1 or 2 may be attached to the wafer abrasive machine shown in FIG. 9. In this case, the wafer "W" is sucked and held onto the holding face 11 of the holding plate 10 by the vacuum generator, so the lower surface of the wafer "W" faces the abrasive face 22 of the abrasive plate 20. Then the wafer "W" is relatively moved with respect to the abrasive plate 20 so as to abrade the lower surface of the wafer "W". While the abrasion, the pressing force of the cylinder unit 56 or the inner pressure of the space 50 is controlled so as to press the lower surface of the wafer "W" onto the abrasive face 22 of the abrasive plate 20 with a proper force.

The external force in the radial direction of the concave section 26 is applied to the holding plate 10 of the top ring "T" during the abrasion, but the movement of the holding plate 10 in the radial direction of the concave section 26 can be prevented by the spherical bodies 9, so that the gravity center and the rotational axis of the wafer "W" can be corresponded during the abrasion. Therefore, the wafer "W" can be abraded uniformly.

Figure 4A:
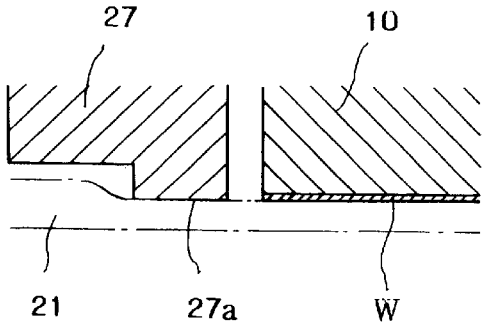
FIGS. 4A and 4B are explanation views showing action of the top ring shown in FIG. 3.
Figure 4B:
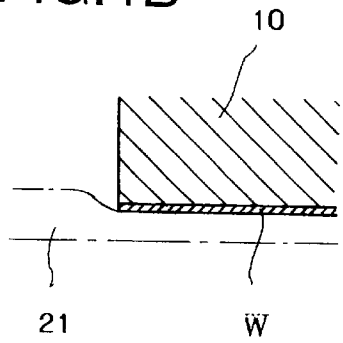

In FIGS. 1 and 2, only the holding plate 10 is suspended and accommodated in the concave section 26 of the head member 24 of the top ring "T". When the wafer "W", which is held by the holding plate 10 of the top ring "T" shown in FIGS. 1 and 2, is pressed onto the abrasive cloth 21 adhered on the upper face of the abrasive plate 20, a part of the abrasive cloth 21 corresponding to the wafer "W" is depressed as shown in FIG. 4B, so that the edge of the wafer "W" is diagonally abraded by a sloped edge of the depressed part of the abrasive cloth 21.

Figure 3:
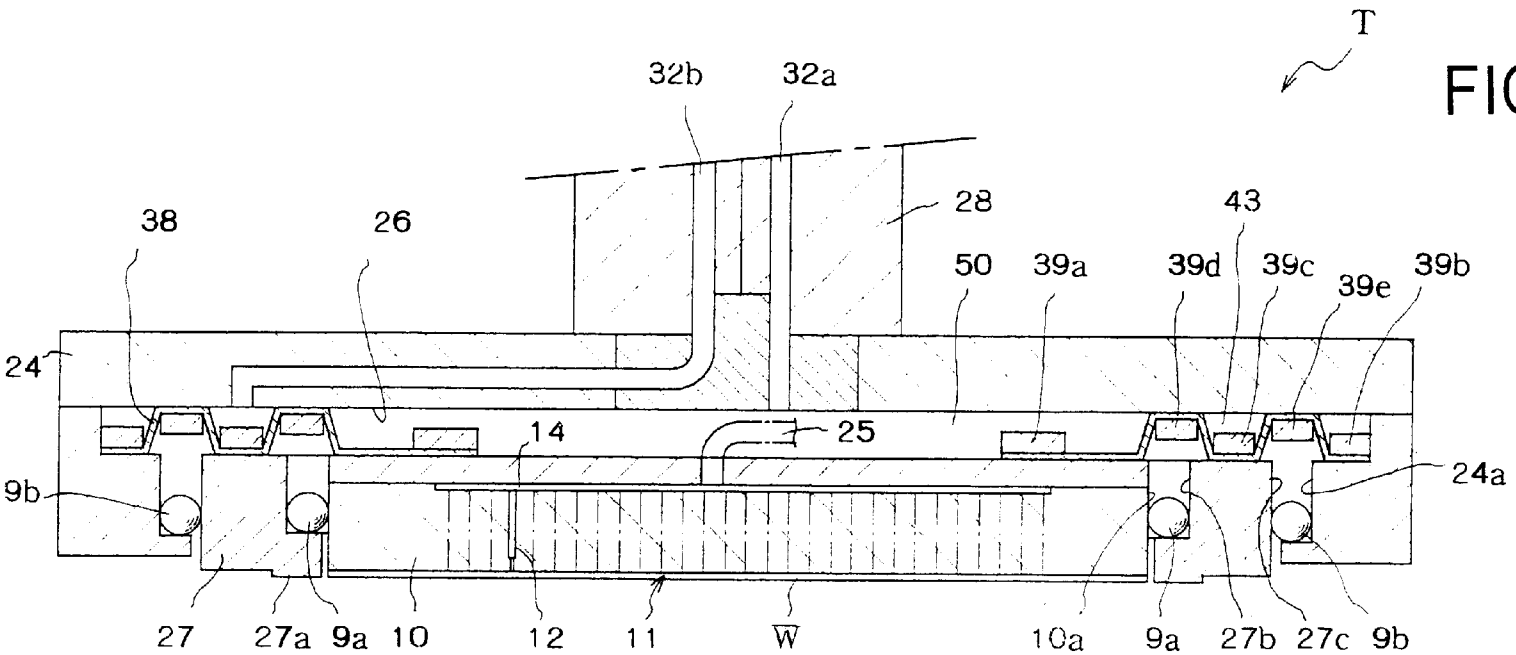
FIG. 3 is a sectional view of a top ring of the wafer abrasive machine of a second embodiment.

The top ring "T" of a second embodiment is shown in FIG. 3. A dress ring 27, which encloses the outer circumferential face 10*a* of the holding plate 10, is provided in the concave section 26 and suspended by the elastic sheet member 38, which is reinforced by the cloth-formed reinforcing member 41, so as to prevent the diagonal abrasion. The dress ring 27 makes the abrasive cloth 21, which abrades the lower surface of the wafer "W", flat. As shown in FIG. 4A, a flat face 27*a* of the dress ring 27 presses the abrasive cloth 21 along the outer edge of the holding plate 10 when the wafer "W" is pressed onto the abrasive cloth 21, so that the edge of the wafer "W" is not abraded by the sloped edge of the depression of the abrasive cloth 21.

The holding pate 10 and the dress ring 27 is suspended by one donut-shaped elastic sheet member 38 and accommodated in the concave section 26.

An inner edge of the elastic sheet member 38, which is reinforced by the cloth-formed reinforcing member 41, is fixed on an upper face of the holding plate 10 by a fixation ring 39*a*; an outer edge of the elastic sheet member 38 is fixed to the head member 24 a fixation ring 39*b*. Further a mid part of the elastic sheet member 38 is fixed on the upper face of the dress ring 27 by a fixation ring 39*c*. With this structure, the holding plate 10 and the dress ring 27 can be suspended by the elastic sheet member 38 and accommodated in the concave section 26.

Further, mid parts of the elastic sheet member 38, which are located between the fixation rings 39*a* and 39*c* and between the fixation rings 39*c* and 39*b* are fixed onto the inner upper face of the concave section 26 by fixation rings 39*d* and 39*e*, so that the elastic sheet member 38 is formed into a zigzag shape and a space 43 is formed on the upper side of the dress ring 27. The compressed air is supplied to and discharged from the space 43 via a connecting path 32*b* of the rotary shaft 28 so as to vertically move the dress ring 27. By the vertical action, the dress ring 27 can be projected form and retracted into the concave section 26 of the head member 24. Further, a projection length of the lower end face 27*a* of the dress ring 27 from the lower end of the concave section 26 can be controlled.

The compressed air is supplied to and discharged from the space 50, which is formed on the upper side of the holding plate 10, via another path 32*b*, which is separated from the path 32*a*. The projection length of the holding face 11 of the holding plate 10 from the lower end of the concave section 26 can be controlled.

In the top ring "T" shown in FIG. 3, the projection lengths of the holding plate 10 and the dress ring 27 can be independently controlled.

Spherical bodies 9*a* are provided between the outer circumferential face 10*a* of the holding plate 10 and an inner circumferential face 27*b* of the dress ring 27, and they simultaneously point-contact the both circumferential faces 10*a* and 27*b*. Further, the spherical bodies 9*a* are arranged along the both circumferential faces 10*a* and 27*b* and point-contact each other.

And, spherical bodies 9*b* are provided between the outer circumferential face 27*c* of the dress ring 27 and the inner circumferential face 24*a* of the head member 24, and they simultaneously point-contact the both circumferential faces 24*a* and 27*c*. Further, the spherical bodies 9*b* are arranged along the both circumferential faces 24*a* and 27*c* and point-contact each other.

By providing the spherical bodies 9*a* and 9*b*, movement of the holding plate 10 and the dress ring 27 in the radial direction of the concave section 26 can be prevented, but the both 10 and 27 can be smoothly projected from and retracted into the concave section 26. And, the holding plate 10 is capable of easily following minute waving or rolling of the abrasive plate 10, which occurs during the abrasion of the wafer "W".

The holding pate 10 shown in FIGS. 1 and 2 is attached to the top ring "T" shown in FIG. 3, so the members used in the top ring shown in FIGS. 1 and 2 are assigned the same symbols and explanation will be omitted.

Figure 5:
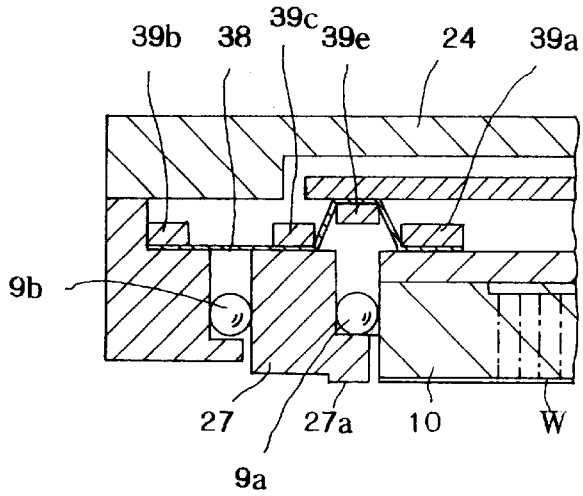
FIG. 5 is a partial sectional view of a modified example of the top ring shown in FIG. 3.

In FIG. 3, the elastic sheet member 38 is provided on the upper side of the dress ring 27 and formed into the zigzag shape so as to form the space 43; as shown in FIG. 5, a part of the elastic sheet member 38, which is located between the fixation rings 39*b* and 39*c*, may be flat.

Figure 6:
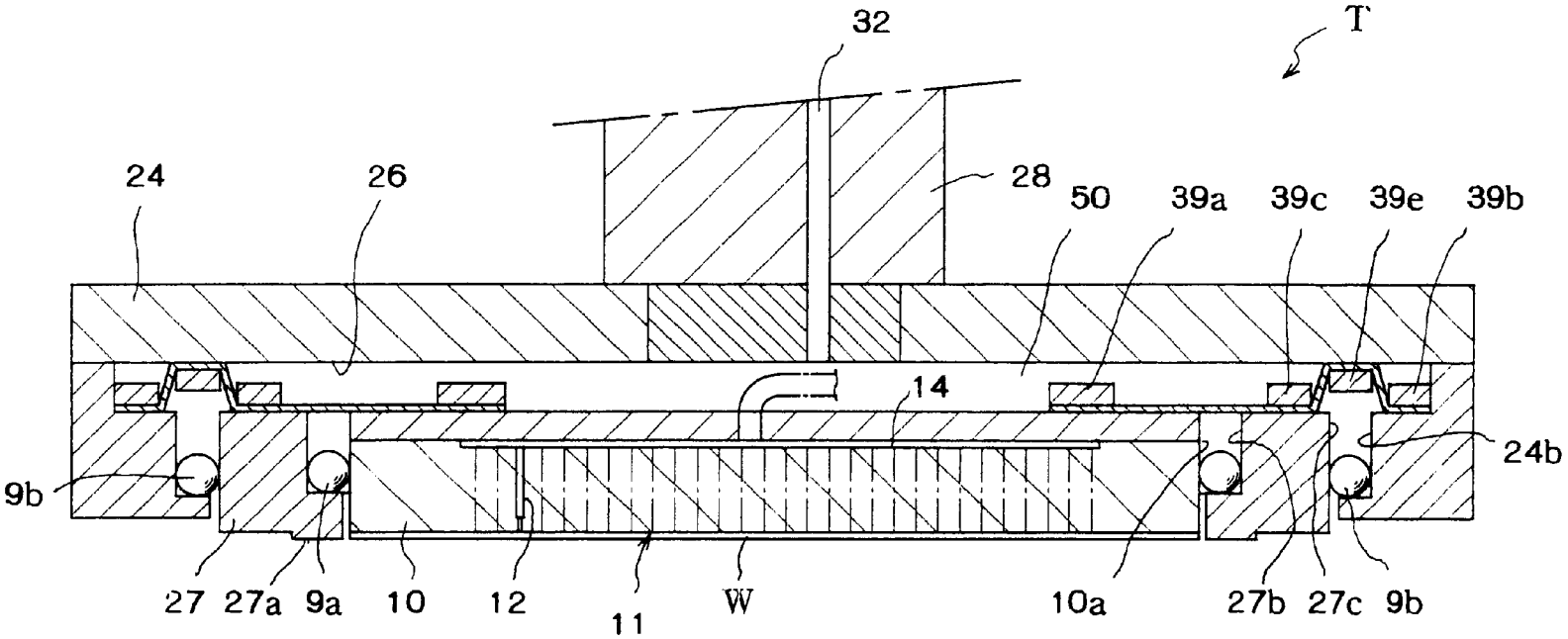
FIG. 6 is a sectional view of another top ring of the wafer abrasive machine of the second embodiment.

In the top ring "T" shown in FIG. 3, the projection lengths of the holding plate 10 and the dress ring 27 are separately controlled; in the top ring "T" shown in FIG. 6, a part of the elastic sheet member 38, which is located between the fixation rings 39*a* and 39*c*, is made flat so as to correspond the space 50 to the upper faces of the holding plate 10 and the dress ring 27, so that the projection lengths of the both 10 and 27 from the lower end of the concave section 26 can be equal.

Figure 7:
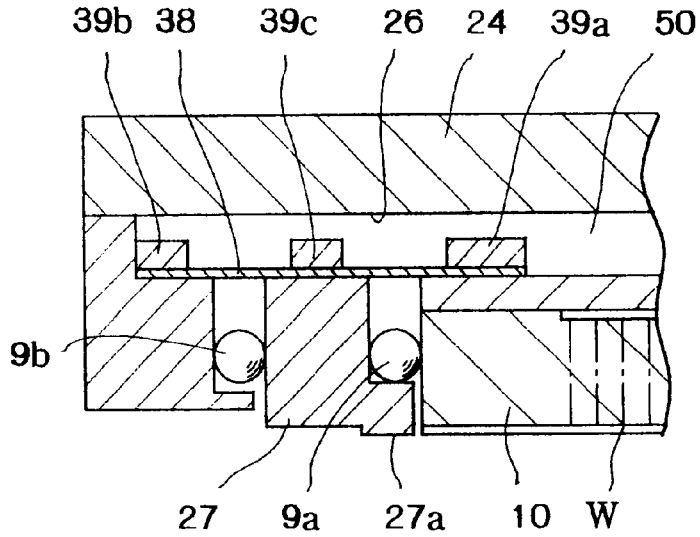
FIG. 7 is a partial sectional view of a modified example of the top ring shown in FIG. 6.

As shown in FIG. 7, the elastic sheet member 38 suspending the holding plate 10 and the dress ring 27 in the concave section 26 may be wholly flat.

Figure 8:
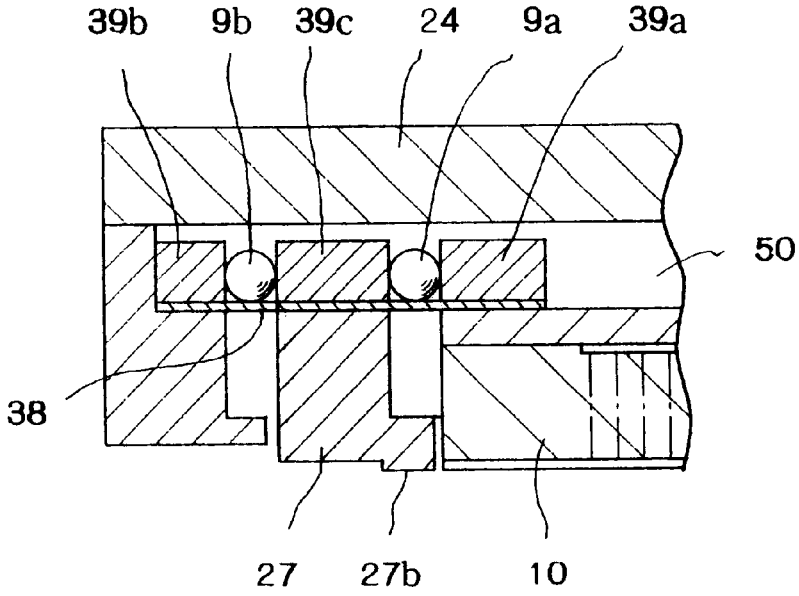
FIG. 8 is a partial sectional view of another modified example of the top ring shown in FIG. 6.

In the top rings "T" shown in FIGS. 3–7, the spherical members 9*a* and 9*b* are provided on the lower side of the elastic sheet member 38, which suspends the holding plate 10 and the dress ring 27, and close to the lower opening end of the concave section 26. The spherical members 9*a* and 9*b* may be provided in the space 50 as shown in FIG. 8. In this case, the spherical bodies 9*a* are provided between the fixation rings 39*a* and 39*c*; the spherical bodies 9*b* are provided between the fixation rings 39*b* and 39*c*. The fixation rings 39*a*, 39*b* and 39*c* are used to fix the elastic sheet member 38 to the head member 24, the holding plate 10 and the dress ring 27.

Preferably, the spherical bodies 9*a* and 9*a* shown in FIGS. 3–8 are made of steel. By considering influences of moisture, they should be made of a corrosion-resistible metal, e.g., stainless steel, titanium. Further, they may be made of a hard corrosion- and chemical-resistible resin, e.g., acrylic.

In the top rings "T" shown in FIGS. 1–8, the wafer "W" is sucked and held onto the holding face 11 of the holding plate 10 by the vacuum generator. The wafer "W" may be adhered onto the holding face 11 by water or an adhesive.

In the wafer adhesive machine of the first embodiment, the movement of the holding plate in the radial direction can be prevented during the wafer abrasion. Therefore, the gravity center and the rotational axis of the wafer can be corresponded during the abrasion, so that the wafer can be uniformly abraded and flatness of the abraded wafer can be improved.

In the wafer adhesive machine of the second embodiment too, the gravity center and the rotational axis of the wafer can be corresponded during the abrasion. Further, the dress ring presses the abrasive face and make it flat, so that the wafer can be further uniformly abraded.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An abrasive machine, in which a surface of a wafer held by a holding plate is pressed onto an abrasive face of an abrasive plate and relatively moved with respect thereto so as to abrade the surface of the wafer, comprising:

a head member including a concave section in which the holding plate, whose wafer holding face is headed toward the abrasive face of the abrasive plate, is accommodated;

an elastic sheet member suspending the holding plate and biasing the holding plate toward an inner part of the concave section of said head member, said elastic sheet member being reinforced by a cloth-formed reinforcing member, a space being formed between said elastic sheet member and an inner upper face of the concave section of said head member, said space being arranged to store pressure fluid which pushes the holding plate toward the abrasive plate against elasticity of said elastic sheet member; and a plurality of spherical bodies being provided between an outer circumferential face of the holding plate and an inner circumferential face of the concave section of said head member, said spherical bodies simultaneously point-contacting both circumferential faces.

2. The abrasive machine according to claim 1, wherein said spherical bodies contact each other.

3. The abrasive machine according to claim 1, wherein said spherical bodies are provided on a lower side of said elastic sheet member.

4. The abrasive machine according to claim 3, wherein said spherical bodies contact each other.

5. The abrasive machine according to claim 1, wherein said spherical bodies are provided on an upper side of said elastic sheet member.

6. The abrasive machine according to claim 5, wherein said spherical bodies contact each other.

7. An abrasive machine, in which a surface of a wafer held by a holding plate is pressed onto an abrasive face of an abrasive plate and relatively moved with respect thereto so as to abrade the surface of the wafer, comprising:

a head member including a concave section in which the holding plate, whose wafer holding face is headed toward the abrasive face of the abrasive plate, and a dress ring, which encloses the holding plate and presses the abrasive face of the abrasive plate so as to make it flat, are accommodated;

an elastic sheet member suspending the holding plate and the dress ring and biasing the both toward an inner part of the concave section of said head member, said elastic sheet member being reinforced by a cloth-formed reinforcing member, a space for being formed between said elastic sheet member and an inner upper face of the concave section of said head member, said space being arranged to store pressure fluid which pushes the holding plate toward the abrasive plate against elasticity of said elastic sheet member; and a plurality of spherical bodies being provided between an outer circumferential face of the holding plate and an inner circumferential face of the dress ring and between an outer circumferential face of the dress ring and an inner circumferential face of the concave section of said head member, said spherical bodies simultaneously point-contacting the circumferential faces.

8. The abrasive machine according to claim 7, wherein said spherical bodies contact each other.

9. The abrasive machine according to claim 7, wherein said spherical bodies are provided on a lower side of said elastic sheet member.

10. The abrasive machine according to claim 9, wherein said spherical bodies contact each other.

11. The abrasive machine according to claim 7, wherein said spherical bodies are provided on an upper side of said elastic sheet member.

12. The abrasive machine according to claim 11, wherein said spherical bodies contact each other.

13. The abrasive machine according to claim 7, wherein said space includes:

a space for storing the pressure fluid which outwardly pushes the holding plate from the concave section of said head member; and another space for storing the pressure fluid which outwardly pushes the dress ring from the concave section of said head member.

14. An abrasive machine, comprising:

an abrasive plate having an abrasive face;

a holding plate for holding a wafer and having a wafer holding face oriented toward said abrasive plate, said holding plate and said abrasive plate being movable relative to one another to enable abrasion of a surface of wafer;

a head member including a concave section, said holding plate being arranged in said concave section;

an elastic sheet member suspending said holding plate and biasing said holding plate toward an inner part of said concave section of said head member, said elastic sheet member being reinforced by a cloth-formed reinforcing member, a space being formed between said elastic sheet member and an inner upper face of said concave section of said head member, said space being arranged to store pressure fluid which operatively pushes said holding plate toward said abrasive plate against elasticity of said elastic sheet member; and a plurality of spherical bodies arranged between an outer circumferential face of said holding plate and an inner circumferential face of said concave section of said head member, said spherical bodies simultaneously contacting said outer circumferential face of said holding plate and said inner circumferential face of said concave section of said head member.

15. The abrasive machine according to claim 14, wherein said spherical bodies contact each other.

16. The abrasive machine according to claim 14, wherein said spherical bodies are arranged on a lower side of said elastic sheet member.

17. The abrasive machine according to claim 16, wherein said spherical bodies contact each other.

18. The abrasive machine according to claim 14, wherein said spherical bodies are arranged on an upper side of said elastic sheet member.

19. The abrasive machine according to claim 18, wherein said spherical bodies contact each other.

20. An abrasive machine, comprising:

an abrasive plate having an abrasive face;

a holding plate for holding a wafer and having a wafer holding face oriented toward said abrasive plate, said holding plate and said abrasive plate being movable relative to one another to enable abrasion of a surface of wafer;

a dress ring enclosing said holding plate and arranged to press said abrasive face of said abrasive plate to flatten said abrasive face;

a head member including a concave section, said holding plate and said dress ring being arranged in said concave section;

an elastic sheet member suspending said holding plate and said dress ring and biasing said holding plate and said dress ring toward an inner part of said concave section of said head member, said elastic sheet member being reinforced by a cloth-formed reinforcing member, a space being formed between said elastic sheet member and an inner upper face of said concave section of said head member, said space being arranged to store pressure fluid which pushes said holding plate toward said abrasive plate against elasticity of said elastic sheet member; and a plurality of spherical bodies arranged between an outer circumferential face of said holding plate and an inner circumferential face of said dress ring and between an outer circumferential face of said dress ring and an inner circumferential face of said concave section of said head member, said spherical bodies simultaneously contacting the adjacent ones of said circumferential faces.

21. The abrasive machine according to claim 20, wherein said spherical bodies contact each other.

22. The abrasive machine according to claim 20, wherein said spherical bodies are arranged on a lower side of said elastic sheet member.

23. The abrasive machine according to claim 22, wherein said spherical bodies contact each other.

24. The abrasive machine according to claim 20, wherein said spherical bodies are arranged on an upper side of said elastic sheet member.

25. The abrasive machine according to claim 24, wherein said spherical bodies contact each other.

26. The abrasive machine according to claim 20, wherein said space includes:

a first portion for storing the pressure fluid which outwardly pushes said holding plate away from said concave section of said head member; and a second portion for storing the pressure fluid which outwardly pushes said dress ring away from said concave section of said head member.

* * * * *